United States Patent [19]

Burnett

[11] 4,365,833

[45] Dec. 28, 1982

[54] SEALING DEVICE

[75] Inventor: Ralph G. Burnett, Kenosha, Wis.

[73] Assignee: American Casting and Manufacturing Company, Plainview, N.Y.

[21] Appl. No.: 137,016

[22] Filed: Apr. 2, 1980

[51] Int. Cl.[3] ..... B65D 33/34

[52] U.S. Cl. ..... 292/318

[58] Field of Search ..... 24/30.5 R, 30.5 P, 16 PB, 24/206 A, 20 TT; 292/316, 318, 319, 320, 321, 322

[56] References Cited

U.S. PATENT DOCUMENTS

| | | | |
|---|---|---|---|
| D. 208,729 | 9/1967 | Geisinger | 24/16 PB |
| 2,163,488 | 6/1939 | Duncan, Jr. | 292/317 |
| 2,977,145 | 3/1961 | Rifkin | 292/321 |
| 3,146,012 | 8/1964 | King, Sr. | 292/320 |
| 3,214,808 | 11/1965 | Litwin | 24/206 A X |
| 4,236,280 | 12/1980 | Kreiseder | 24/16 PB |

*Primary Examiner*—Richard E. Moore

*Attorney, Agent, or Firm*—Allegretti, Newitt, Witcoff & McAndrews

[57] ABSTRACT

A sealing device which is particularly for use with a receptacle such as a cloth bank bag for containing money or currency, in which a single strip or band of material is formed of metal or plastic stamped with projections or serrations extending from one side of the band and wherein locking projections are stamped in the material near one end of the band, so that the other end thereof may be inserted through slits formed by oppositely facing panels in the one end of the band, whereby one or more of the serrations are engaged and locked by edges of the locking projections which are provided by one set of the panels when the strip is tightened around the neck of the bag. Movement of the ends of the strips is thereby prevented in a direction which would unlock the seal but is freely permitted in the other direction for the extent of the serrations so that a tight seal may be accomplished. The material adjacent the panels is provided with sets of inwardly extending spikes to engage the material of the bag when the sealing device is in place and tightened, so that the sealing device may not be removed from the bag without tearing or destroying the same and thus immediately providing evidence of tampering or attempted pilferage. In the construction disclosed, the projections or serrations extend from one side of the band toward the receptacle to be sealed, such as the neck of a bank bag, thus covering and concealing the locking mechanism of the locking device and frustrating attempts to tamper therewith.

In addition, a pair of transverse protuberances are included on the undersurface of one end portion of the band. The protuberances, which are preferably rounded, facilitate the movement of the body portion when the sealing device is tightened around the bag and provide for a space therebetween which allows insertion of a sharp tool, for example a knife, to sever and remove the sealing device from the bag without cutting the fabric of the bag.

8 Claims, 8 Drawing Figures

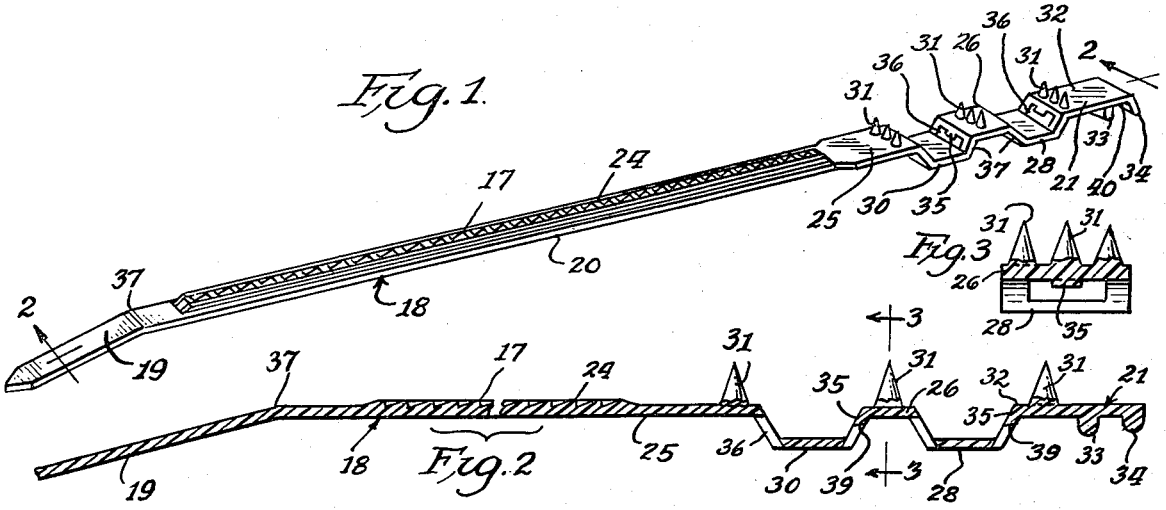
Fig. 1.
Fig. 2
Fig. 3
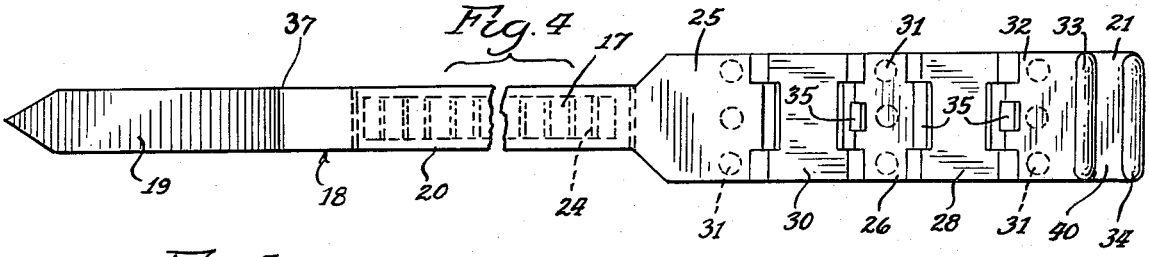
Fig. 4
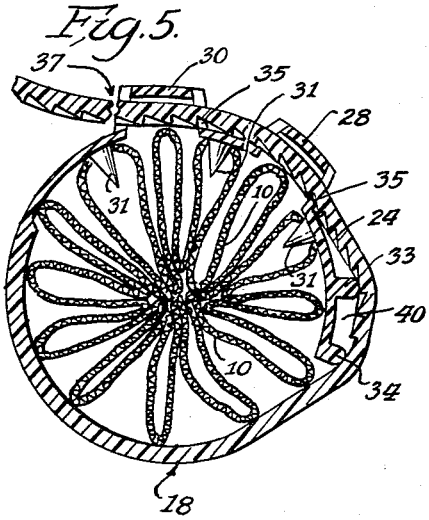
Fig. 5.
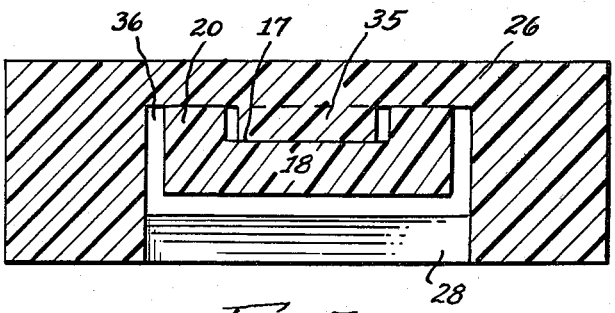
Fig. 7.
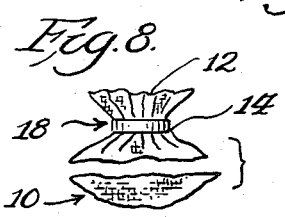
Fig. 8.
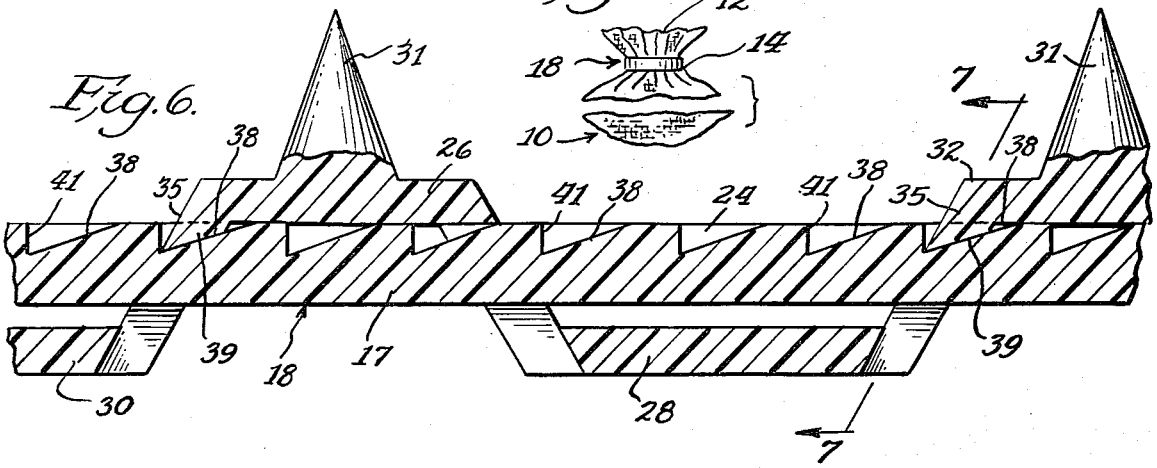
Fig. 6.

SEALING DEVICE

BACKGROUND OF THE INVENTION

Heretofore bank bags, which are usually formed of heavy cloth such as duck or denim for carrying money, currency or the like, have been provided with a seal around the open neck thereof so that access to the interior of the bag or receptacle cannot be obtained without breaking the seal. In this manner, it is immediately apparent whether or not the seal has been tampered with and the interior of the contents of the bag either removed therefrom or some material which is worthless has been substituted for the original contents of the bag. One such seal is shown, for example, in Canter et al. U.S. Pat. No. 2,654,624.

It has been found that with careful manipulation, the former sealing devices used, which were usually formed of a soft material such as lead which was tightened or deformed after strings were inserted through holes therein by a tool to restrain or hold the strings in place around the neck of the bag and which had teeth or points which would dig into the bag so that removal of the seal is difficult, did not always serve their intended purpose and were relatively expensive. One reason that they were unsatisfactory was because persons with sufficient patience and strength could carefully manipulate the seal so that it could be removed from the bag and the contents thereof either pilfered or changed and the seal could then be carefully replaced around the neck of the open end of the bag with no readily visible indication that the seal had been tampered with. In bank bags, this is a decided disadvantage because such bags at times contain valuable material sealed in the bags and the bags may not be opened for a considerable period of time. If pilferage or substitution is not discovered immediately, it is difficult to trace the person or persons who tampered with the bag or to determine when or where the tampering took place. Furthermore, such seals were usually formed of materials which are relatively expensive, such as lead, for example, and required a special tool to secure them on the bag after the contents have been placed therein.

Other seal constructions which are useable with a cloth bag, for example, are shown in Rifkin, U.S. Pat. No. 2,977,145, and Marchese et al., U.S. Pat. No. 3,748,697. While these patents disclose a seal construction formed of a band of resilient, yieldable material with interlocking teeth to hold the yieldable material in position when tightened, the seals are readily accessible, which is obviously undesirable since they can be relatively easily broken externally of the sealing band.

Another seal construction is illustrated in my copending application Ser. No. 951,569, filed Oct. 15, 1978 for Bank Bag Sealer and assigned to the assignee of the present application. This application is an improvement on the bank bag sealer shown in the said application Ser. No. 951,569.

The present invention provides an improved and inexpensive, foolproof sealing device particularly for bank bags. It provides an inexpensive and foolproof sealing device for bank bags and the like which cannot be removed from the bag without tearing or mutilating the bag materials, whereby it is immediately apparent that the bag has been tampered with and the seal removed. The purpose also is to provide a seal of the type wherein the only manner in which the seal may be removed from the bag is by cutting or severing the same with a cutting tool. The visual appearance of the bag and seal is such that it will be immediately apparent that the seal was improperly removed or attempted to be replaced, although this is quite difficult to do without further mutilating or tearing the bag material.

It is an object of the invention to provide a bag seal which is inexpensive and may be manufactured in large quantities very cheaply from metal stampings or molded plastic strips such as formed from materials known by the trademarks Nylon or Delrin.

Referring again to application Ser. No. 951,569, it will be noted that the sealing device disclosed in the present application has its locking serrations no longer projecting outwardly, but rather projecting inwardly so that they are in contact with the surface of the bag. Furthermore, the central portion of the strip containing the serrations is now solid and any slits have been eliminated, which facilitates manufacture. Furthermore, one end portion of the strip has been bent at a 15° angle to facilitate assembly of the sealing device. In addition, projecting spears or spikes have been added to the inner surface of the strip to better engage the material of the bag. The triangular barbs of the former construction have been eliminated. An additional panel has been added to the strip and two longitudinal rails have been provided on the body portion and are on the same surface as the serrations. The two rails lie along the two edges of the body portion and enclose the serrations. Furthermore, the rails are elevated above the surface of the body portion and the serrations are thus recessed in relation thereto. Locking edges of the previous panels have been retained but additional locking panels and projections have been added to engage and lock with the serrations and the projections are shaped so as to accurately conform to the shape of the serrations. In addition, the bag's resistance to compression produces an outwardly expanding radial force which causes the projections to tightly interlock with the serrations. Moreover, because the serrations are projected inwardly against the surface of the bag the body portion and the panels cover and conceal the locking mechanism of the sealing mechanism.

Two rounded bearing surfaces have also been added to the under surface of one end of the strip and extend transversely thereof. The rounded surfaces facilitate the movement of the body portion when the sealing device is tightened around the bag and also provide a space therebetween. The space allows insertion of a sharp tool, such as a knife, and affords a ready construction to afford removing of the sealing device from the bag without cutting the fabric of the bag.

SUMMARY OF THE INVENTION

The invention relates to a sealing device useable, for example, on bank bags or the like, which sealing device is formed from a band of material which circumferentially surrounds and tightly seals the open neck end of the bag when in place and which will visually indicate improper attempts to remove the seal from the bag. The device is constructed so that no sharp edges or protuberances extend outwards from the band after it has been secured.

BRIEF DESCRIPTION OF THE DRAWING

FIG. 1 is a perspective view of the sealing device or sealer;

FIG. 2 is a transverse sectional view taken on line 2—2 of FIG. 1;

FIG. 3 is a cross sectional view taken on line 3—3 of FIG. 2;

FIG. 4 is a plan view of the sealer;

FIG. 5 is a midline transectional view of the sealer when the ends thereof have been placed in the locked position to form a circumferential locked ring around the neck of a bank bag;

FIG. 6 is an enlarged transverse sectional view of the assembled sealing device when fully assembled and functioning;

FIG. 7 is a sectional view taken along line 7—7 of FIG. 6; and

FIG. 8 is a fragmentary elevation view of a bank bag with the sealer attached thereto.

DESCRIPTION OF THE PREFERRED EMBODIMENT

FIG. 8 illustrates a band bag 10 which is usually formed of heavy cloth material such as duck, denim, or the like. The bag 10 is provided with an open top 12 and when the bag is closed, the material thereof may be gathered together to form a neck 14.

A sealing device is placed around the neck of the bag as shown, for example, in FIG. 8. The sealing device comprises a strip of flexible material in the form of a blank or band 18 as shown in FIGS. 1, 2, 3, 4 and 6 and is preferably formed of metal, such as aluminum or steel or of heavy, strong plastic material such as Nylon or Delrin. The blank or band 18 is provided with a central body portion 17 and opposite ends 19 and 21. The portion 17 is formed with a plurality of teeth or serrations 24 on the side thereof which will eventually face the bag 10. The central body portion 17 is solid and the sloped portions of the teeth provide a sloping flat surface 38 intersecting with a vertical surface 41.

The end portion 19 of the band 18 is bent at a 15° angle along line 37 to facilitate assembly of the sealing device. Spears 31 are provided at the other end portion 21. Preferably, there are nine spears arranged in three groups of three spears disposed in transverse lines across the end portion 21. The nine spears penetrate between the fibers of the fabric of the bag 10 as shown in FIG. 5 when the band 18 is tightened into locking engagement with the bag. Opposed panels 25, 26, 28, 30 and 32 are formed on end portion 21 of the band 18 and slits 36 are formed transversely of connecting portions 37 thereof. The upper panels 26 and 32 are provided with projections 35 with include flat sloped surfaces 39. Surfaces 39 engage over their full flat extent with the flat portions 38 of serrations 24 and the lead edge of projection 35 is locked against surface 41 of serration 24.

Two longitudinal rails 20 are provided on the body portion 17 and are on the same surface as the serrations 24. The two rails 20 lie along the two edges of the body portion and thus enclose the serrations 24. The two rails 20 are elevated above the surface of the body portion 17 to a greater degree than the elevation of the serrations 24 and the serrations 24 are therefore recessed relative to the rails 20.

As shown in FIG. 5, the bag's resistance of compression will produce an outwardly expanding radial force which will cause the projections 35 to interlock with the serrations 24. The outward expanding force will be resisted by the body portion 17. Moreover, because the serrations 24 project toward the surface of the bag, the body portion 17 and the panels 28 and 30 cover and conceal the locking mechanism of the sealing device, thus frustrating any attempts to tamper with the sealing mechanism.

Two elevated transverse bearing surfaces or protuberances 33 and 34 have been added to the undersurface of the end portion 21. The protuberances 33 and 34 are provided with rounded surfaces and facilitate the movement of the body portion 17 when the sealing device is tightened around the coin bag 10. Also of great importance is the fact that the transverse protuberances 33 and 34 provide space 40 therebetween (FIG. 5) which allows insertion of a sharp tool, such as a knife for example, for removing the sealing device from the bag 10 without cutting the fabric thereof.

The present device creates a bank bag sealing device which is formed from a single piece of material which is easy to use and which may be secured to the bag with considerable tightness and with relatively little strength necessary on the part of the person applying the sealing device. Furthermore, the present sealing device is less expensive than prior art lead seals. Also, the seal of the present invention may be manufactured on automatic machinery. It is to be noted that when the seal is tightened as shown in FIG. 5 that the end portion 19 tends to fracture and can be broken and severed from the central portion 17. Therefore, the central portion 17 preferably does not project from the seal. In addition, the portions of the seal which face outwardly contain no sharp edges which might scratch or gouge a person handling the bag or the seal after it has been placed on the bag.

While I have disclosed a presently preferred embodiment of the invention, the invention is intended to be limited only by the scope of the appended claims.

What is claimed is:

1. A sealing device for a receptacle having at least one open end, which receptacle consists at least in part of deformable material adjacent the open end thereof, so that the material may be gathered together to form a neck, said sealing device comprising a relatively thin band of flexible material which is of sufficient strength that it is manually severable only by cutting through the same, said band comprising an elongated, flat body portion and a pair of end portions at the extremities thereof, a plurality of serrations formed on the side of the flat body portion of the band which faces the receptacle when secured thereto, one end portion of the band being substantially flat, means on the other end of the band for cooperating with said serrations to lock the band in a circumferentially closed position when secured to the receptacle, said last means comprising a plurality of opposed panels forming slits therethrough of the band, certain of said edges being formed with surfaces to conform with at least a portion of the serrations when the one end of the band is inserted through said slits and the band is manually tightened about the neck of the receptacle, and transverse and spaced apart rounded protuberances formed on the extremity of said other end of the band on the side thereof opposite the serrations to provide a sliding bearing surface for the band when secured to the receptacle and also providing a space thereafter for the insertion of a cutting tool to afford removal of the band from the receptacle without injury to the receptacle.

2. A sealing device as claimed in claim 1 including a plurality of sharp protuberances formed on said other end of the band on the same side thereof as said serrations and adapted to pierce the neck of said receptacle when the device is tightened about the neck thereof.

3. A sealing device as claimed in claim 2 wherein the plurality of sharp protuberances are spaced longitudinally of said other end portion of the band.

4. A sealing device as claimed in claim 3 wherein said protuberances are also spaced transversely of said other end portion of the band.

5. A sealing device as claimed in claim 1 wherein said one end of the band is provided with a bent portion to facilitate the insertion thereof through said slits.

6. A sealing device for an object to be sealed comprising a relatively thin band of flexible material which is of sufficient strength that is manually severable only by cutting through the same, said band comprising an elongated, flat body portion and a pair of end portions at the extremities thereof, a plurality of serrations formed on the side of the flat body portion of the band which faces the object on which the sealing device is to be placed, one end portion of the band being substantially flat, and means on the other end of the band for cooperating with said serrations to lock the band in a circumferentially closed position when secured, said last means comprising a plurality of opposed panels having slits therethrough and having edges thereon extending transversely of the band, certain of said edges being formed with surfaces to conform with at least a portion of the serrations when the one end of the band is inserted through said slits and the band is manually tightened.

7. A sealing device as claimed in claims 1 and 6 wherein the opposed panels having said serration engaging edges thereon face the object to be sealed when the band is assembled thereabout.

8. A sealing device as claimed in claim 6 wherein transverse and spaced apart rounded protuberances are formed on the extremity of said other end of the band on the side thereof opposite the serrations to provide a sliding bearing surface for the band when secured to the object, and also providing a space thereafter for the insertion of a cutting tool to afford removal of the band from the object without injury to the object.

* * * * *